US006679571B2

(12) United States Patent
Lawson et al.

(10) Patent No.: US 6,679,571 B2
(45) Date of Patent: Jan. 20, 2004

(54) CONVERTIBLE FURNITURE

(76) Inventors: Jack L. Lawson, 8531 Shelbyville Rd., Indianapolis, IN (US) 46259; Nancy J. Rasche, 2124 Hanna Ct., Lebanon, IN (US) 46052; Dennis M. Turner, 11600 Mann Rd., Mooresville, IN (US) 46158; Edmund M. Apperson, IV, 1142 Bitterwood Ct., Columbus, IN (US) 47201

( * ) Notice: Subject to any disclaimer, the term of this patent is extended or adjusted under 35 U.S.C. 154(b) by 44 days.

(21) Appl. No.: 09/891,889

(22) Filed: Jun. 26, 2001

(65) Prior Publication Data

US 2002/0195907 A1 Dec. 26, 2002

(51) Int. Cl.[7] ..... A47B 17/00

(52) U.S. Cl. ..... 312/195; 312/240; 312/249.9; 312/334.7

(58) Field of Search ..... 312/194, 195, 312/208.1, 249.9, 313, 322, 323, 330.1, 334.7, 348.1, 348.2, 348.5, 350

(56) References Cited

U.S. PATENT DOCUMENTS

| | | | | | |
|---|---|---|---|---|---|
| 747,581 | A | * | 12/1903 | Boule | 312/196 |
| 1,115,996 | A | * | 11/1914 | Wilson | 312/107 |
| 2,501,309 | A | * | 3/1950 | Braver | 312/237 |
| 2,653,071 | A | * | 9/1953 | Lundstrom | 312/325 |
| 2,787,007 | A | * | 4/1957 | Erdkamp | 5/2.1 |
| 3,123,416 | A | * | 3/1964 | Sovik, Jr. | 312/195 |
| 3,160,448 | A | * | 12/1964 | Abernathy et al. | 312/323 |
| 3,427,666 | A | * | 2/1969 | Saxe | 312/314 |
| 3,427,669 | A | | 2/1969 | Swenson | |
| 3,784,273 | A | * | 1/1974 | Nikolai | 248/254 |
| 3,841,727 | A | | 10/1974 | Peng | |
| 3,883,196 | A | * | 5/1975 | Mohr et al. | 312/194 |
| 3,885,845 | A | | 5/1975 | Krieks | |
| 4,026,616 | A | * | 5/1977 | Kuehl | 312/201 |
| 4,314,734 | A | * | 2/1982 | Grunert | 108/8 |
| 4,361,919 | A | | 12/1982 | Hull | |
| 4,441,771 | A | * | 4/1984 | Roesler | 312/322 |
| 4,846,078 | A | * | 7/1989 | Janson | 108/101 |
| 4,940,149 | A | | 7/1990 | Vineis | |
| 4,989,927 | A | * | 2/1991 | Suvak | 312/277 |
| 5,022,721 | A | | 6/1991 | Melgers | |
| 5,067,183 | A | | 11/1991 | Urquiola | |
| 5,205,629 | A | * | 4/1993 | Simons | 312/249.9 |
| 5,226,714 | A | * | 7/1993 | Wright | 312/323 |
| 5,297,305 | A | | 3/1994 | Williams | |
| 5,345,880 | A | * | 9/1994 | Shamie | 108/63 |
| 5,401,095 | A | * | 3/1995 | Williams et al. | 312/249.9 |
| 5,615,936 | A | * | 4/1997 | Simmons et al. | 312/194 |
| 5,772,295 | A | * | 6/1998 | Sundmark | 312/242 |
| 5,797,666 | A | * | 8/1998 | Park | 312/223.3 |
| 5,957,558 | A | * | 9/1999 | Quade | 312/246 |
| 5,971,504 | A | * | 10/1999 | Kelley et al. | 248/188.4 |
| 6,125,487 | A | * | 10/2000 | Ive | 5/655 |
| 6,126,257 | A | * | 10/2000 | Carpenter et al. | 211/41.12 |

FOREIGN PATENT DOCUMENTS

| | | | |
|---|---|---|---|
| DE | 2353372 | * | 5/1974 |
| SE | WO 8001449 | * | 7/1980 |

* cited by examiner

*Primary Examiner*—Lanna Mai
*Assistant Examiner*—John Fitzgerald
(74) *Attorney, Agent, or Firm*—Barnes & Thornburg

(57) ABSTRACT

A furniture kit includes several pieces of furniture which can be combined in one way to produce an infant changing table and in another way to produce a desk. The furniture kit includes a table, a drawer, a chest, and an infant changer.

23 Claims, 5 Drawing Sheets

10
18
36
82
16
84
80
34
20
30
22
12
46
42
44
40
49
14
52
15
50
54
69
13

12
22
42
32
20
49
64
82
34
30
66
68
60
62
36
84
40
16

CONVERTIBLE FURNITURE

BACKGROUND AND SUMMARY OF THE INVENTION

This invention relates to convertible furniture, and particularly, this invention relates to furniture that is convertible from one configuration to another configuration. More particularly, this invention relates to infant changing tables and to desks.

An infant changing table provides a convenient place for a caregiver to lay an infant down while changing clothing and diapers. As the infant grows older and larger, a changing table is no longer needed. Instead, the infant's family or the now-older child might need a study or computer desk.

According to the present disclosure, a furniture unit includes several pieces which cooperate to provide a furniture kit and which can be combined in one way to produce an infant changing table and in another way to produce a desk. The furniture unit includes a table having a table top, a chest sized to fit under the table top, and a drawer. The furniture unit also includes a drawer mount configured to enable a user to mount the drawer on the table to lie perpendicular to the table top when the pieces in the furniture unit are assembled to produce an infant changing table and to lie parallel to the table top when the pieces in the furniture unit are assembled to produce a desk.

In one changing table configuration, the chest is arranged to lie in an opening under the table top and the drawer hangs on the table in a position "hidden" out of sight behind the chest. The drawer mount is used to hang the drawer under and in perpendicular relation to the table top and behind the chest. A padded changer is placed on the table top and arranged to receive an infant thereon. The chest is arranged so that its drawers can be pulled outwardly to provide access to infant diapers, clothing, and accessories stored therein and under the table top.

In one desk configuration, the chest is removed from the opening under the table top and the "hidden" drawer is removed. The drawer mount is now used to suspend the drawer on the table under and in parallel relation to the table top so that the drawer can slide under the table top between opened and closed positions. The chest can now be used as a separate piece along with a desk defined by the table and the sliding drawer under the table top.

In one presently preferred embodiment, the table also includes a tower comprising, for example, a cabinet under the table top and a drawer unit above the table top. The cabinet and a frame member cooperate to support the table top in an elevated position above the ground and define an opening therebetween for receiving the chest therein when the pieces in the furniture unit are arranged to produce an infant changing table.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
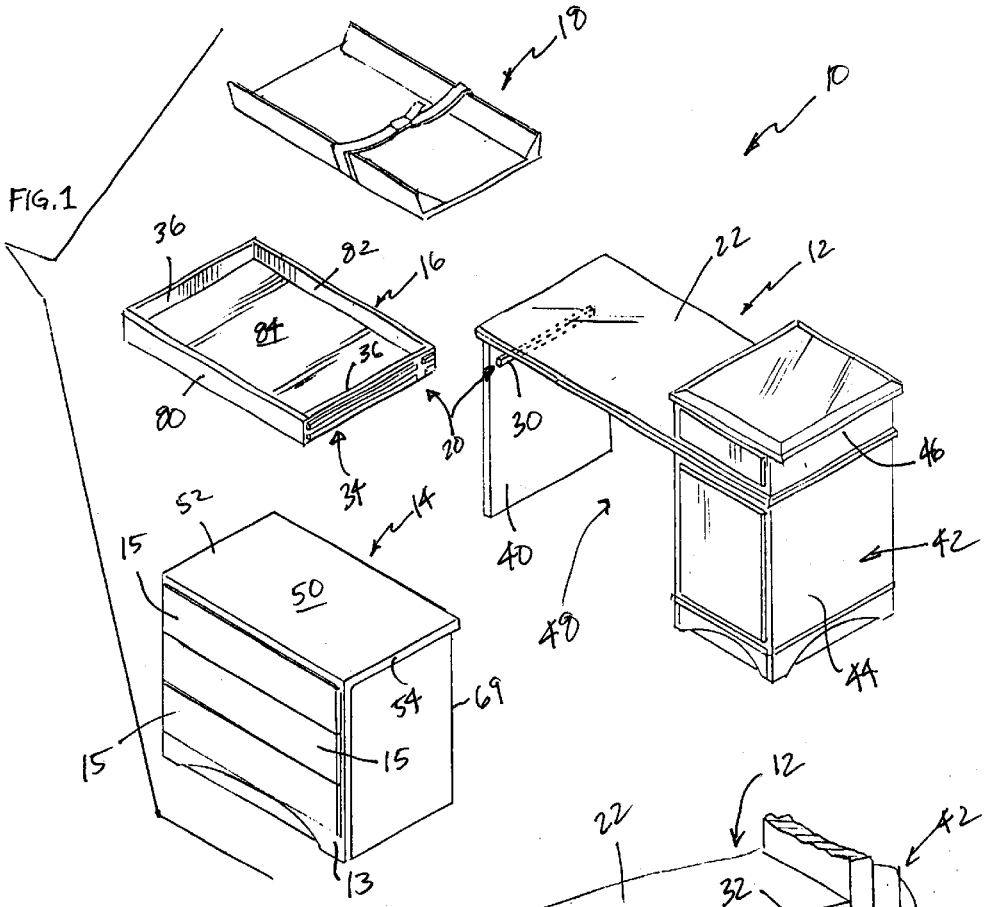
FIG. 1 is a perspective view of a furniture unit including a table provided with a cabinet under the table top and a drawer unit above the table top, a drawer, a chest, and an infant changer.
Figure 4:
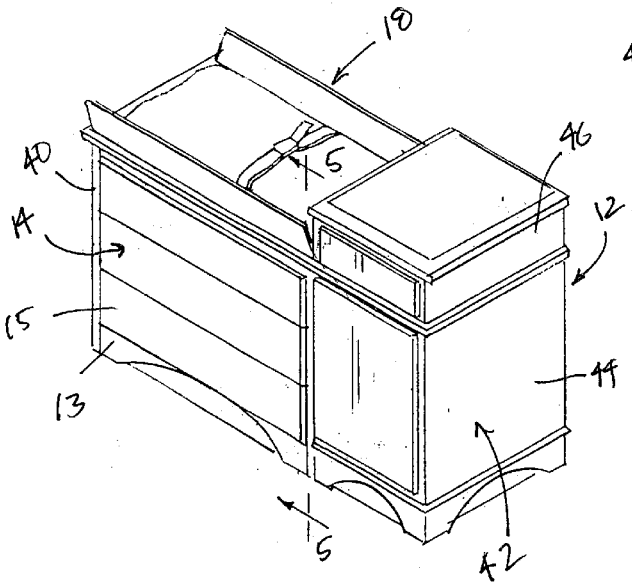
FIG. 4 is a perspective view of the changing table configuration of the furniture unit showing the infant changer on the table top and the chest in the opening under the table top and the infant changer.
Figure 9:
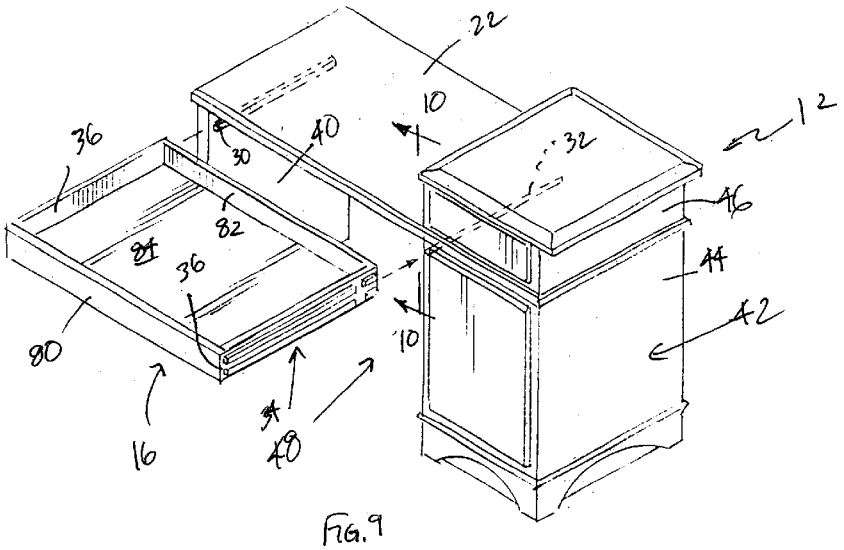
FIG. 9 is a perspective view similar to FIG. 6 showing the orientation of the drawer prior to installation of the drawer under the table top during conversion of the furniture unit to produce a desk having a horizontal sliding drawer.
Figure 12:
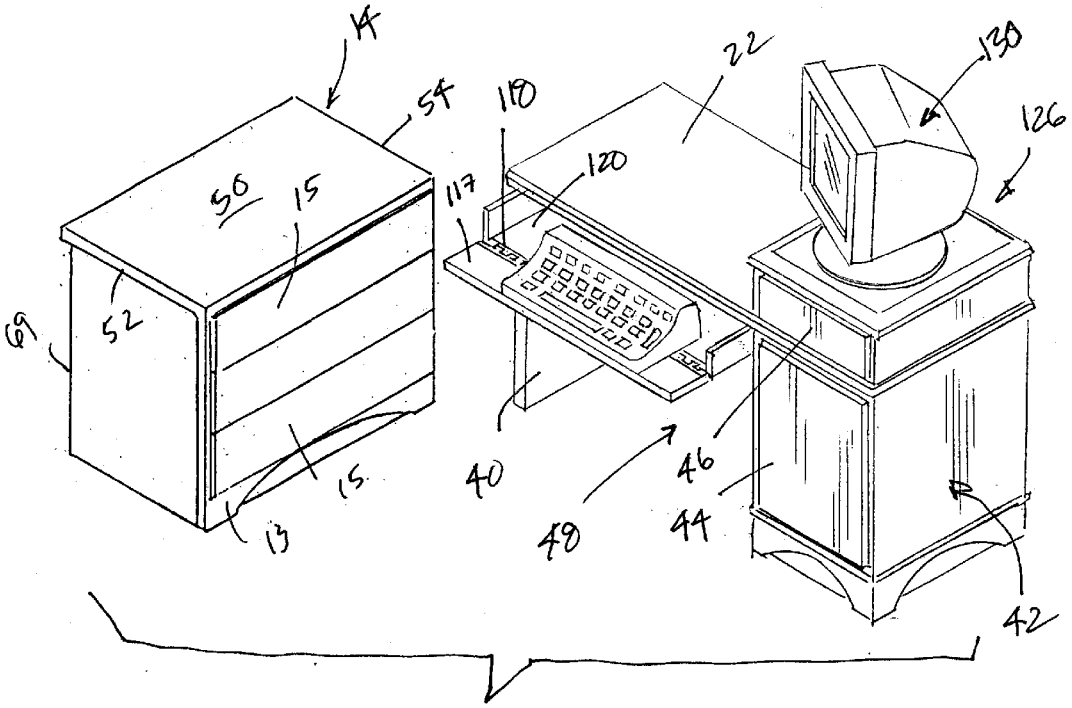
FIG. 12 is a perspective view of a furniture unit similar to the unit shown in FIGS. 1–11 wherein the drawer has been modified somewhat to include a foldable front face suitable for hiding and supporting a computer keyboard and showing use of the chest as a piece separate from the desk.

A furniture unit 10, shown, for example, in FIG. 1, includes various components which can be combined in one way to produce an infant changing table as shown, for example, in FIG. 4 and in other ways to produce a desk as shown, for example, in FIGS. 9 and 12. Furniture unit 10 provides a furniture kit that includes a table 12, a chest 14, a drawer 16, and an infant changer 18.

Figure 2:
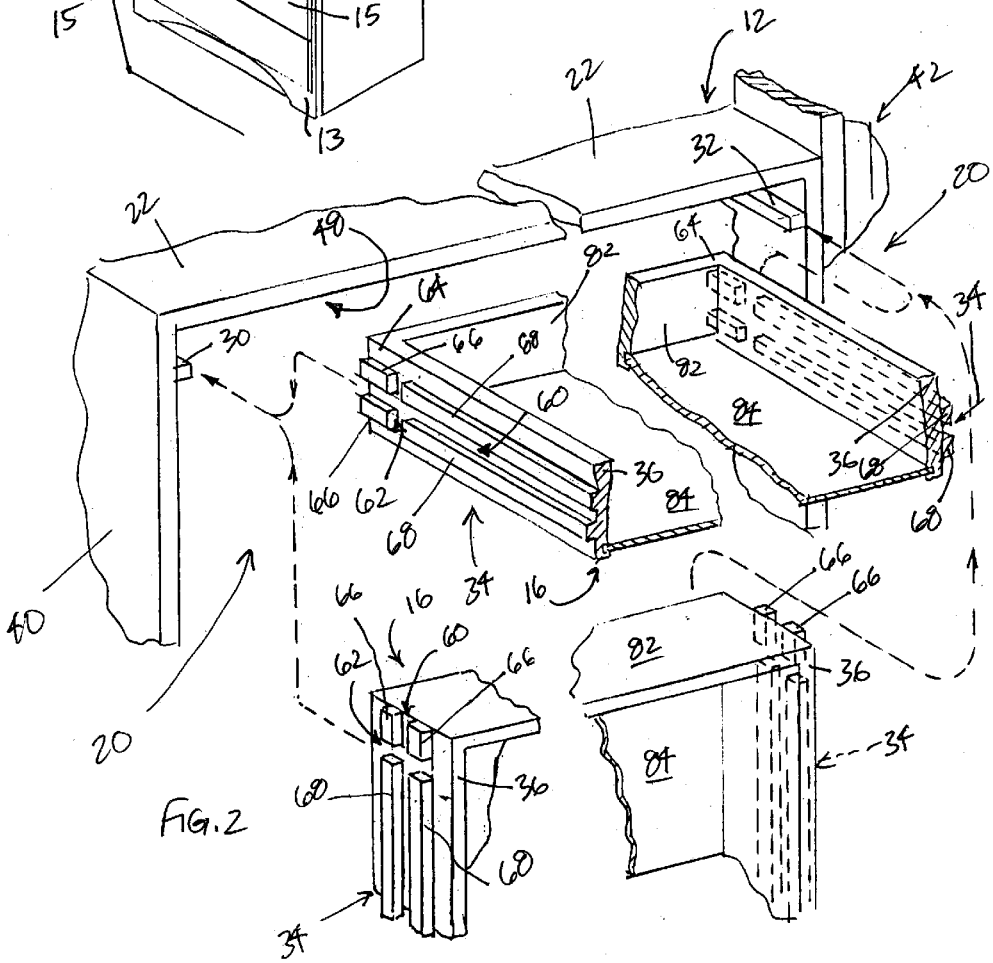
FIG. 2 is an enlarged perspective view of portions of the furniture unit of FIG. 1 showing a drawer mount used to support the drawer on the table in either a sliding or hanging position under the table top, the drawer mount including two spaced-apart tracks fixed to the table and a set of rails fixed on each side wall of the drawer and arranged to provide a "long" slot receiving the tracks therein when the drawer is arranged to slide back and forth under the table top in the changing table configuration of the furniture unit and a "short" slot receiving the tracks therein when the drawer hangs on the table behind the chest in the desk configuration of the furniture unit.
Figure 5:
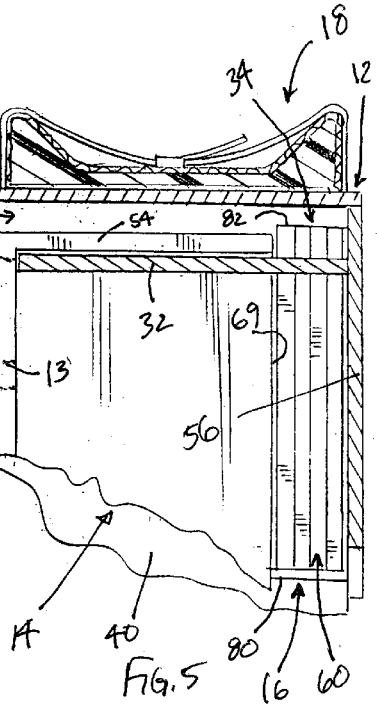
FIG. 5 is a sectional view taken along line 5—5 of FIG. 4 showing use of the drawer mount to hang the drawer behind the chest in an out-of-the-way hidden storage position.
Figure 6:
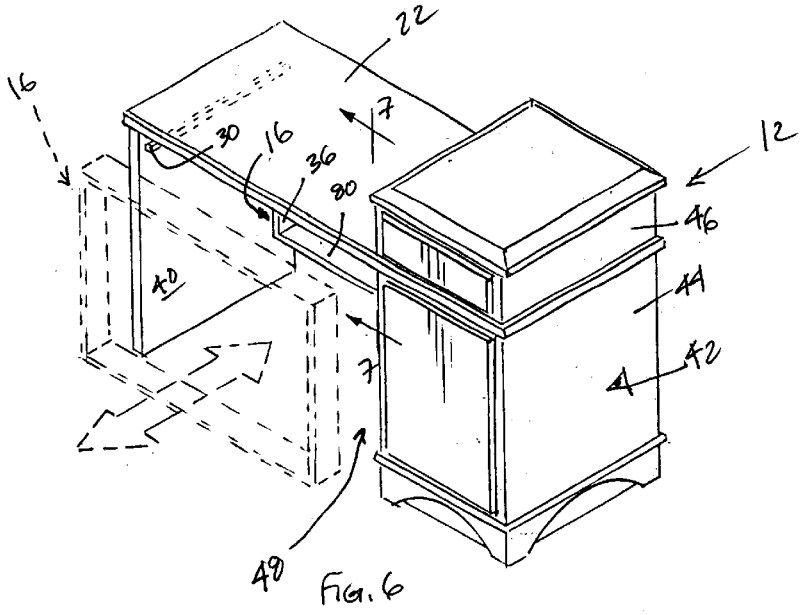
FIG. 6 is a perspective view of the table after the chest has been removed but before removal of the hanging drawer.
Figure 7:
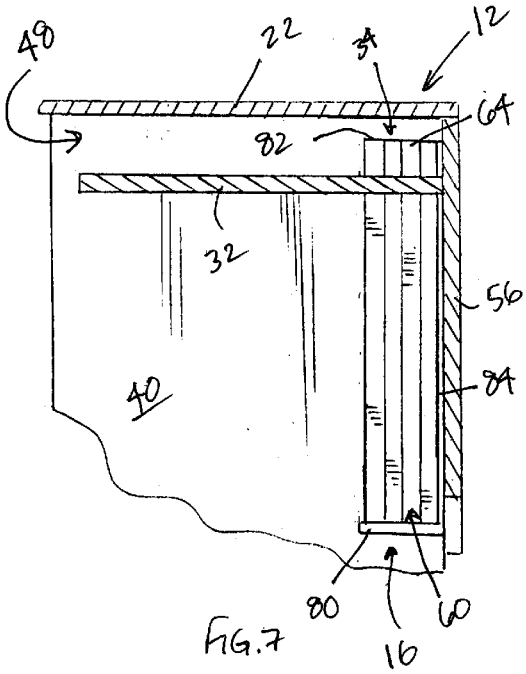
FIG. 7 is a sectional view taken along line 7—7 of FIG. 6 showing the drawer hanging vertically on a track inserted into one of the short slots located on the drawer.
Figure 8:
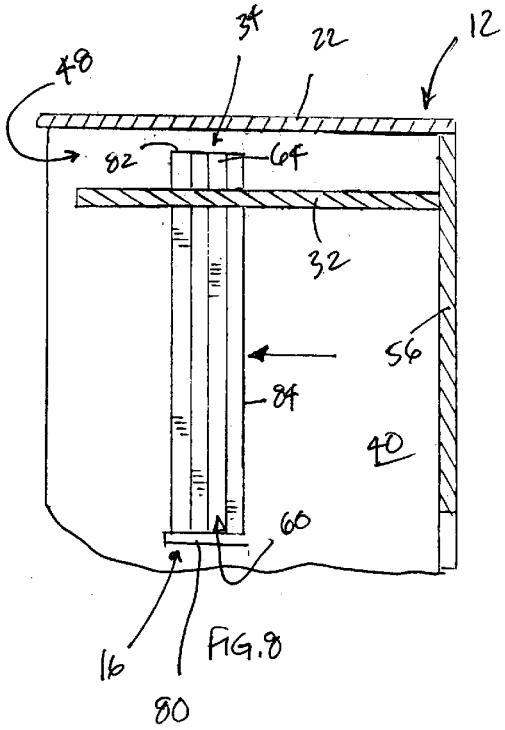
FIG. 8 is a sectional view similar to FIG. 7 showing vertical sliding movement of the hanging drawer during removal of that drawer from the opening formed in the table.
Figure 10:
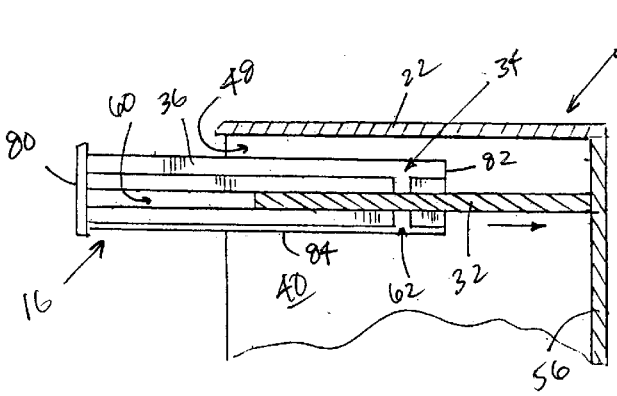
FIG. 10 is a sectional view taken along line 10—10 of FIG. 9 showing insertion of one of the tracks into one of the long slots located on the drawer and horizontal sliding movement of the drawer toward its closed position under the table top.
Figure 11:
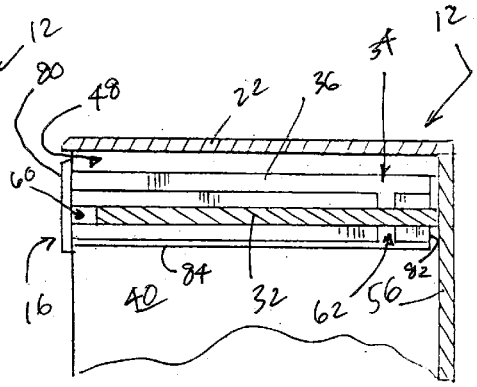
FIG. 11 is a sectional view similar to FIG. 10 showing the drawer in its closed position under the table top.

A drawer mount 20 shown, for example, in FIG. 2 is used to support drawer 16 on table 12 in a hanging position under a table top 22 included in table 12 and behind chest 14 when furniture unit components 10 are combined to produce an infant changing table 24 as shown, for example, in FIGS. 4 and 5. Drawer mount 20 is also used to support drawer 16 on table 12 in a horizontal sliding position under table top 22 when furniture unit components 10 are combined to produce desk 26 shown in FIGS. 9–11 and desk 126 shown in FIGS. 12–14. In the illustrated embodiment, drawer mount 20 includes two spaced-apart tracks 30, 32 fixed to table 12 and a set of rails 34 fixed on each side wall 36 of drawer 16 and configured to engage tracks 30, 32.

Table 20 includes means for supporting table top 22 in an elevated position above the ground so that chest 14 can be slid into an opening provided under table top 22 when furniture unit components 10 are combined to produce an infant changing table as shown in FIG. 4. In the illustrated embodiment, table 20 includes a left-side support such as panel 40 located to elevate a left-side portion of table top 22 and a right-side support such as tower 42 located to elevate a right-side portion of table top 22. Any suitable legs or other supports could be used to support table top 22 in a selected elevated position above the ground. In the illustrated embodiment, tower 42 includes a cabinet 44 under table top 22 and a drawer unit 46 above table top 22.

Figure 3:
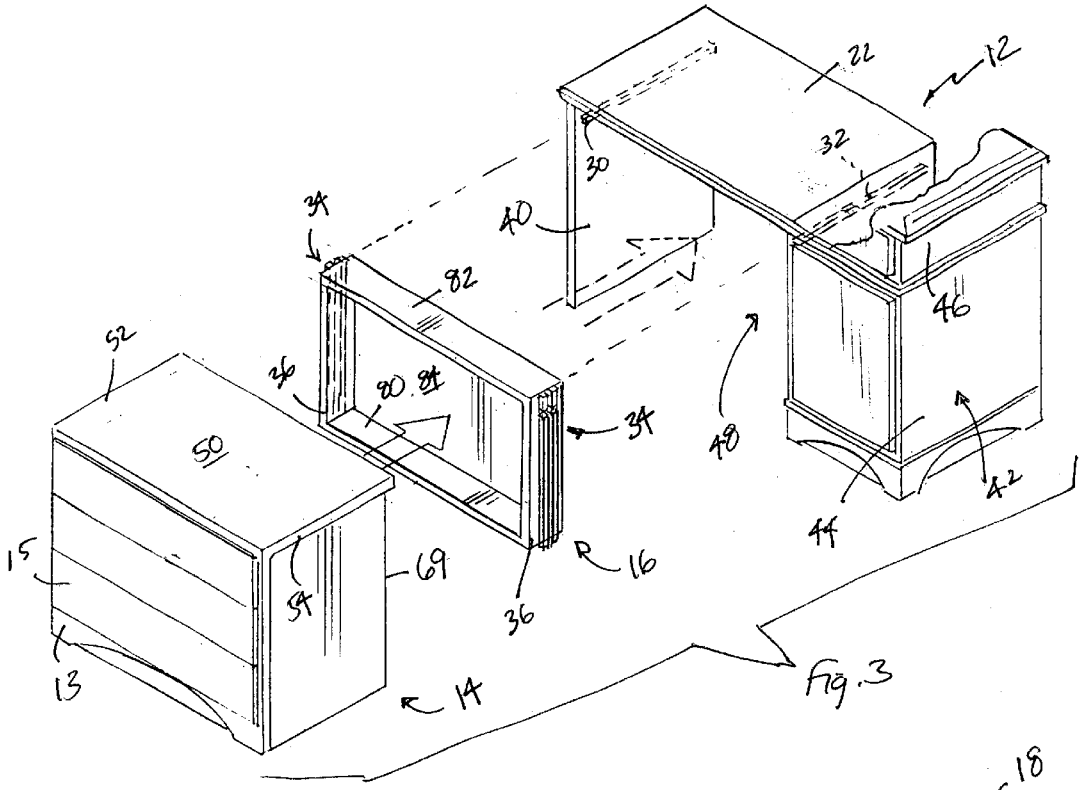
FIG. 3 is a perspective assembly view showing insertion of the drawer and chest into an opening formed in the table during "creation" of the changing table configuration.

Chest 14 is sized to fit into an opening 48 provided under table top 22 and between left-side and right-side table top supports 40, 42 as suggested, for example, in FIGS. 3–5. Chest 14 is located in opening 48 when furniture unit components 10 are combined to produce an infant changing table. Chest 14 is removed from opening 48 when furniture unit components 10 are combined to produce a desk as shown, for example, in FIGS. 9 and 12. Chest 14 includes a front wall 13 formed to include openings for drawers 15 as shown, for example, in FIGS. 1 and 5.

Infant changer 18 is placed on table top 22 when chest 14 is located in opening 48 and drawer 16 is supported in opening 48 behind chest 14 in the vertical position by drawer mount 20. Changer 18 is padded to receive an infant thereon and may be fixed to table 12 or otherwise retained in place on table top 22 using any suitable means.

Referring now to FIGS. 3 and 5, tracks 30, 32 included in drawer mount 20 are arranged and chest 14 is configured so that drawer mount tracks 30, 32 do not obstruct or otherwise interfere with movement of chest 14 into and out of opening 48 in table 12 during conversion of furniture unit components 10 from an infant changing table configuration to a desk configuration and vice versa. In the illustrated embodiment, chest 14 includes a top 50 provided with overhanging flanges 52, 54. When chest 14 is located in opening 48, flange 54 will lie above drawer mount track 32 as shown, for example, in FIG. 5, and flange 52 will lie above drawer mount track 30. In that installed position, flanges 52, 54 also lie below table top 22.

Table 12 also includes a rear panel 56 depending from a rear edge of table top 22 as shown, for example, in FIG. 5. Rear panel 56 and chest 14 cooperate to define a space therebetween for receiving drawer 16 when it is hung on tracks 30, 32 to assume a hidden "storage" position behind chest 14 when furniture unit components 10 are combined to produce an infant changing table. When drawer 16 is positioned to lie in the storage position, drawer 16 lies under a rear portion of table top 22 to provide space in opening 48 so that chest 14 can be located in opening 48 under a front portion of table top 22 as shown, for example, in FIGS. 4 and 5.

Referring now to FIG. 2, each set of rails 34 provided on drawer 16 is formed to provide a long or longitudinal slot 60 extending along the length of drawer side wall 36 and a short or lateral slot 62 extending across the width of drawer side wall 36. The long and short slots 60, 62 intersect near a rear end 64 of drawer side wall 36. Each slot 60, 62 is sized to receive one of drawer mount tracks 30, 32 therein. In the illustrated embodiment, two short rails 66 and two long rails 68 are provided on each drawer side wall 36 and arranged to form the long and short slots 60, 62. It is within the scope of this disclosure to append rails 66, 68 to drawer side wall 36, to form drawer side wall 36 to include rails 66, 68, or to "rout" or otherwise form slots 60, 62 in drawer side wall 36.

The two short rails 66 are arranged to lie in spaced-apart parallel relation to one another to define a portion of long slot 60 therebetween as shown in FIG. 2. The two long rails 68 are arranged to lie in spaced-apart parallel relation to one another to define another portion of long slot 60 therebetween. One end of each short rail 66 lies in spaced-apart relation to one end of a companion long rail 68 to define a portion of short slot 62 therebetween as shown, for example, in FIG. 2.

Drawer 16 can be mounted to hang out of sight behind chest 14 in table opening 48 and in perpendicular relation to table top 22 when furniture unit components 10 are combined to produce an infant changing table as suggested in FIGS. 2–5. As shown in FIG. 2, drawer 16 can be oriented to extend vertically and drawer 16 can be moved into table opening 48 to cause drawer mount racks 30, 32 to fit into short slots 62 provided on drawer side walls 36. Thus mounted, drawer 16 can be slid rearwardly and vertically on tracks 30, 32 to lie adjacent to rear panel 56 of table 12. Then, chest 14 can be moved into opening 48 to "hide" hanging drawer 16 in a space provided between rear panel 56 of table 12 and a rear wall 69 of chest 14 (so that drawer 16 is not visible to someone standing next to drawers included in chest 14). This process can be reversed whenever it is desired to convert the infant changing table to a desk.

Drawer 16 can be mounted to slide horizontally under table top 22 between opened and closed positions when furniture unit components 10 are combined to produce a desk as suggested in FIGS. 2 and 9–11. As shown in FIG. 2, drawer 16 can be oriented to extend horizontally and drawer 16 can be moved into table opening 48 to cause drawer mount tracks 30, 32 to fit into long slots 60 provided on drawer side walls 36. Thus mounted, drawer 16 can slide horizontally on tracks 30, 32 as it is moved between its opened and closed positions and during movement into and out of table opening 48.

Drawer 16 includes a front wall 80, a rear wall 82, and a bottom wall 84 coupled to walls 36, 80, and 82. Rear wall 82 lies next to table top 22 and front wall 80 faces downwardly toward the ground when drawer 16 is hung vertically in its hidden storage position and furniture components 10 have been combined to produce an infant changing table. Rear wall 82 lies next to rear panel 56 and front wall faces toward a student (not shown) seat at the desk when drawer 16 is mounted in its horizontal sliding position and furniture components have been combined to produce a desk.

Figure 14:
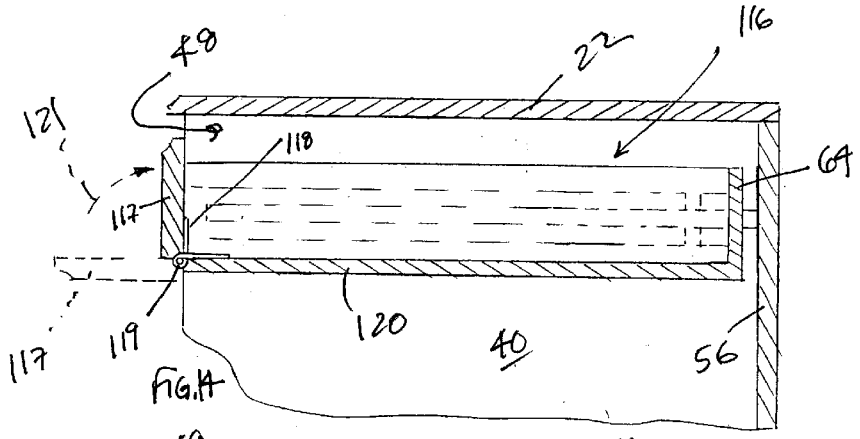
FIG. 14 is a sectional view similar to FIG. 13 showing the drawer in its closed position.
Figure 13:
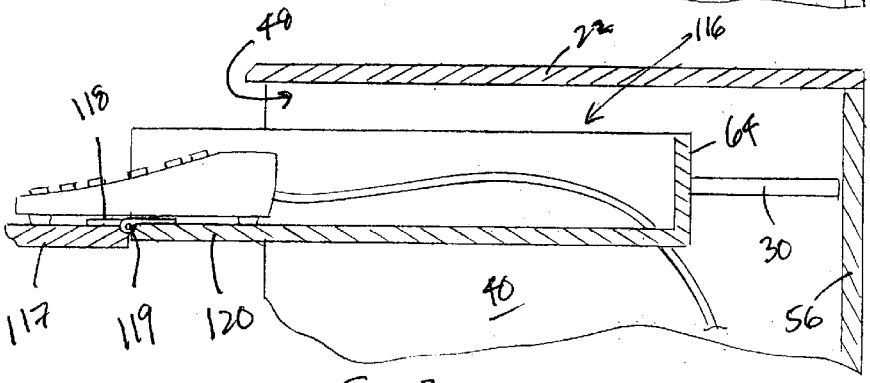
FIG. 13 is a sectional view taken along line 13—13 of FIG. 12 showing a keyboard placed on an opened drawer.

Referring now to FIGS. 12–14, desk 126 includes a drawer 116 having a front wall 117 mounted on a hinge 118 to pivot about axis 119 relative to bottom 120 of drawer 116 as shown in FIG. 14. Front wall 117 can be pivoted about axis 119 to assume an opened position as shown in FIGS. 12 and 13 so that a computer keyboard can straddle front wall 117 and a portion of drawer bottom 120. Front wall 117 can be pivoted in direction 121 about axis 119 to assume a closed position as shown in FIG. 14. As shown in FIG. 12, chest 14 can be used alongside desk 126 to provide a furniture set since chest 14 is no longer nested in table opening 48. A monitor 130 can be placed on top of drawer unit 46 and a computer (not shown) can be placed inside cabinet 44.

Although the invention has been described in detail with reference to certain preferred embodiments, variations and modifications exist within the scope and spirit of the invention as described and defined in the following claims.

What is claimed is:

1. A furniture unit comprising a table including a table top and two supports arranged to elevate the table top above an underlying surface, the table being fanned to include an opening under the table top, a drawer sized to fit into the opening under the table top, a drawer mount configured to support the drawer coupled to the table top adapted for movement generally parallel to the table top placing the drawer in the opening under the table top in one of a horizontal position under the table top and a vertical position under the table top at the option of a user handling the drawer, and wherein the drawer mount comprises one or more rails on one or more of the supports.

2. The furniture unit of claim 1, further comprising a chest sized to fit in the opening and located in the opening under the table top in front of the drawer when the drawer is supported in the vertical position under the table top by the drawer mount.

3. The furniture unit of claim 1, wherein one of the supports includes a tower having a cabinet under the table top and a drawer unit above the tab top.

4. The furniture unit of claim 1, further comprising an infant changer on the table top when a chest is located in the opening and the drawer is supported in the opening behind the chest in the vertical position by the drawer mount.

5. The furniture unit of claim 1 wherein the drawer mount includes a track coupled to each of the supports and a slot formed on each side wall of the drawer and arranged to receive one of the tracks therein to facilitate sliding movement of the drawer relative to the table top on the tracks.

6. The furniture unit of claim 1, wherein the drawer mount includes a set of rails arranged on each side wall of the drawer to lie opposite one of the tracks and formed to define a short slot having a first length extending laterally across a width of the side wall and a long slot having a longer, second length extending longitudinally along a width of the side wall and each track extends into and through one of the short slots to support the drawer in the vertical position.

7. The furniture unit of claim 1, wherein the drawer mount includes a track on each support and longitudinal slots provided on each side wall of the drawer to receive the tracks therein to support the drawer in the horizontal position and lateral slots provided on each side wall of the drawer to receive the tracks therein to support the drawer in the vertical position.

8. The furniture unit of claim 2, wherein the chest includes a frame having a front wall formed to include drawer openings and a back wall and the drawer lies adjacent to the back wall of the chest when the chest is located in the opening and the drawer is supported in the vertical position under the table top.

9. The furniture unit of claim 2, wherein the table further includes a rear panel depending from a rear portion of the table top and lying between the supports and the rear panel and the chest cooperate to define therebetween in the opening a space containing the drawer supported in the vertical position by the drawer mount.

10. The furniture unit of claim 2, wherein the chest includes a base and a top mounted on the base to form overhanging flanges on each side of the base, the drawer mount includes a track coupled to each of the supports, and each overhanging flange is positioned to lie between the table top and one of the tracks when the chest is located in the opening under the table top in front of the drawer.

11. The furniture unit of claim 3, wherein a chest is positioned to lie in the opening under the table top alongside the cabinet.

12. The furniture unit of claim 9, wherein the drawer mount includes a track coupled to each of the supports and a slot formed on each side wall of the drawer and arranged to receive one of the tracks therein to facilitate sliding movement of the drawer relative to the table top on the tracks.

13. The furniture unit of claim 9, wherein the drawer mount includes a set of rails arranged on each side wall of the drawer to lie opposite one of the tracks and formed to define a short slot having a first length extending laterally across a width of the side wall and a long slot having a longer, second length extending longitudinally along a width of the side wall and each track extends into and through one of the short slots to support the drawer in the vertical position.

14. The furniture unit of claim 7, wherein the drawer mount includes a set of rails provided on each side wall of the drawer, each set of rails includes two short rails arranged to lie in spaced-apart parallel relation to one another to define a portion of the longitudinal slot therebetween and two long rails arranged to lie in spaced-apart parallel relation to one another to define another portion of the longitudinal slot therebetween, and one end of each short rail lies in spaced-apart relation to one end of a companion long rail to define a portion of the lateral slot therebetween.

15. A furniture unit comprising a table including a table top and a support arranged to elevate the table top above an underlying surface, the table being formed to include an opening under the table top, a chest located in the opening under a front portion of the table top, a drawer located in the opening under a rear portion of the table top in a vertical storage position behind the chest, a drawer mount configured to hang the drawer in the vertical storage position above the underlying surface, and wherein the drawer mount comprises one or more rails on one or more of the supports.

16. The furniture unit of claim 15, wherein the drawer mount is configured to support the drawer on the table in a horizontal position under the table top upon removal of the chest from the opening under the table top.

17. The furniture unit of claim 15, wherein the table further includes a rear panel depending from a rear portion of the table top and lying in spaced relation to the chest to define therebetween a space containing the drawer in the vertical storage position.

18. The furniture unit of claim 15, wherein the drawer mount includes a pair of tracks arranged to lie in spaced-apart parallel relation to one another and a first track-receiving slot on each side wall of the drawer and each track extends into one of the first track-receiving slots to support the drawer in the vertical storage position.

19. The furniture unit of claim 18, wherein the chest includes a base and a top mounted on the base to form overhanging flanges on each side of the base and each overhanging flange is positioned to lie between the table top and one of the tracks when the chest is located in the opening under the table top.

20. The furniture unit of claim 18, wherein the drawer mount further includes a second track-receiving slot on each side wall of the drawer an each track extends into one of the second track-receiving slots to support the drawer in a horizontal position under the table top upon removal of the chest from the opening under the table top and removal of the tracks from the first track-receiving slots.

21. The furniture unit of claim 20, wherein the first and second track-receiving slots are arranged to intersect.

22. A furniture kit including components capable of being assembled in the field in one way to produce an infant changing table and in another way to produce a desk, the furniture kit comprising a table including a table top and a support arranged to elevate the table top above an underlying surface to define an opening under the table top, a chest, a drawer, a drawer mount, and an infant changer, wherein the drawer mount supports the drawer on the table in a vertical storage position in the opening under the table top, the chest lies in the opening under the table top in front of the drawer, and the infant changer lies on the table top to produce an infant changing table, and wherein the chest lies outside of the opening away from the table, the drawer mount supports the drawer on the table in a horizontal use position in the opening under the table top to slide back and forth between opened and closed positions, and the infant changer lies away from the table to produce a desk.

23. A furniture unit comprising a table including a table top and left-side and right-side table top supports arranged to elevate the table top above an underlying surface, the table top and the left-side and right-side table top supports cooperating to form an opening under the table top, a first track coupled to the left-side table top support and arranged to lie in the opening under the table top, a second track coupled to the right-side table top support and arranged to lie in the opening under the table top and in spaced-apart relation to the first track to support a slidable platform thereon for movement into and out of the opening under the table top, and a chest sized to fit into the opening to lie under the table top, the chest including a left-side exterior side wall arranged to lie in spaced-apart confronting relation to the left-side table top support to define a left-side space containing the first track therein when the chest is not connected to the first track and positioned to lie in the opening under the table top, the chest further including a right-side exterior side wall arranged to lie in spaced-apart confronting relation to the right-side table top support to define a right-side space containing the second track therein when the chest is not connected to the second track and positioned to lie in the opening under the table top.

* * * * *